US008680416B2

(12) United States Patent
Nakajima et al.

(10) Patent No.: US 8,680,416 B2
(45) Date of Patent: Mar. 25, 2014

(54) DIAL SWITCH

(75) Inventors: Hirokatsu Nakajima, Yokkaichi (JP); Satoru Chaen, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 98 days.

(21) Appl. No.: 13/511,917

(22) PCT Filed: Nov. 10, 2010

(86) PCT No.: PCT/JP2010/006604

§ 371 (c)(1),
(2), (4) Date: May 24, 2012

(87) PCT Pub. No.: WO2011/064953

PCT Pub. Date: Jun. 3, 2011

(65) Prior Publication Data

US 2012/0279841 A1 Nov. 8, 2012

(30) Foreign Application Priority Data

Nov. 24, 2009 (JP) ..... 2009-266205

(51) Int. Cl.
*H01H 19/14* (2006.01)

(52) U.S. Cl.
USPC ..... 200/564

(58) Field of Classification Search
USPC ..... 200/564, 336, 61.54, 61.55, 4, 5 R, 14, 200/17 R, 18, 1 B, 339, 61.56, 61.57, 553, 200/6 A, 520
See application file for complete search history.

(56) References Cited

U.S. PATENT DOCUMENTS

| | | | | |
|---|---|---|---|---|
| 2,759,371 | A * | 8/1956 | White | 74/567 |
| 3,184,557 | A * | 5/1965 | Clarcy | 200/4 |
| 3,612,789 | A * | 10/1971 | Marquis et al. | 200/47 |
| 2008/0264329 | A1 | 10/2008 | Itoh et al. | |

FOREIGN PATENT DOCUMENTS

| | | |
|---|---|---|
| JP | U-57-95730 | 6/1982 |
| JP | U-63-134418 | 9/1988 |
| JP | A-2008-204022 | 9/2008 |
| JP | A-2008-293952 | 12/2008 |
| JP | A-2009-117164 | 5/2009 |

OTHER PUBLICATIONS

Feb. 15, 2011 International Search Report issued in PCT/JP2010/006604.

* cited by examiner

*Primary Examiner* — Edwin A. Leon
(74) *Attorney, Agent, or Firm* — Oliff PLC

(57) ABSTRACT

A dial switch includes a rotary portion which has an uneven peripheral surface, a plunger, a holding portion which holds the plunger such that the plunger is movable in a reciprocating manner, and a coil spring which biases the plunger. The holding portion extends along a moving path of the plunger, and has a guide surface that surrounds the plunger from the outside. The plunger includes: an outer wall which has an outer peripheral surface which is arranged close to the guide surface and an inner peripheral surface having an inner diameter larger than an outer diameter of the coil spring, and an inner shaft which has a rear end at a position inside the outer wall and in front of a rear end of the outer wall and allows the coil spring to be mounted on an outer side thereof.

12 Claims, 9 Drawing Sheets

(A)

(B)

DIAL SWITCH

The present application is the U.S. National Phase of PCT/JP2010/006604, filed Oct. 11, 2010, which claims priority to Japanese Patent Application No. 2009-266205, filed Nov. 24, 2009, the disclosures of which are hereby incorporated by reference in their entirety.

BACKGROUND

The exemplary embodiments relate to a dial switch used for operating an electronic apparatus or the like mounted on a vehicle or the like.

SUMMARY

A switch disclosed in JP-A-2000-156129 is a dial switch which gives a click feeling to a user when the user rotates a dial knob for operating an electronic apparatus or the like.

This dial switch includes, as shown in FIG. 8 and FIG. 9, a ring-shaped dial knob 102 and a support member (not shown in the drawing) that rotatably supports the dial knob 102. The support member is provided with a click portion 104, which gives a click feeling to a user when the user rotates the dial knob 102.

The dial knob 102 has an uneven peripheral surface 106 on which a concave portion that radially retracts and a convex portion that radially projects are alternately repeated in the circumferential direction. The click portion 104 includes a plunger 108 formed of a metal ball, a plunger holding portion 110 which houses the plunger 108 such that the plunger 108 is movable along the radial direction of the dial knob 102 in a reciprocating manner, and opens at a position where the plunger 108 faces the uneven peripheral surface 106 such that the plunger 108 is brought into contact with the uneven peripheral surface 106, and a compression coil spring 112 (hereinafter, referred to as "coil spring") which biases the plunger 108 toward the uneven peripheral surface 106 by a resilient repulsive force thereof in a state where the plunger 108 is brought into contact with the uneven peripheral surface 106 in the plunger holding portion 110.

In the dial switch 100, that is in an inoperative state, as shown in FIG. 10, a portion of the plunger 108 that is biased by the coil spring 112 projects from an opening 110*a* of the plunger holding portion 110. This is brought into contact with the uneven peripheral surface 106 of the dial knob 102 in a state where the plunger 108 is fitted in a concave portion 106*a* of the uneven peripheral surface 106. When the dial knob 102 is rotatably operated in such a state, the plunger 108 pushed to the convex portion 106*b* of the uneven peripheral surface 106 is moved inwardly in the radial direction of the dial knob 102 (see D1 of FIG. 11). When the dial knob 102 is continuously rotated, the plunger 108 goes beyond a top of the convex portion 106*b* (see FIG. 12) and is fitted in the neighboring concave portion 106*a* due to a resilient repulsive force of the coil spring 112 (see FIG. 10). This series of operation is repeated as the dial knob 102 is rotated. Due to this reciprocating movement of the plunger 108 which follows the concave portions and the convex portions of the uneven peripheral surface 106 in a state where the plunger 108 is pushed to the uneven peripheral surface 106 by a resilient repulsive force of the coil spring 112, a torque generated when the dial knob 102 is rotated is periodically changed, and click feeling is acquired by this periodic change of the torque.

In the dial switch, even when a speed of the rotation of a dial knob is changed or the dial knob is rotated in either left or right direction, the smooth reciprocating movement of the plunger in the plunger holding portion becomes important in order to acquire a uniform click feeling.

In the above-mentioned dial switch 100, in order to acquire a click sound in addition to the acquisition of click feeling at the time of rotatably operating the dial knob 102, the plunger 108 does not perform the smooth reciprocating movement. That is, in the above-mentioned dial switch 100, when the plunger 108 is pushed by the convex portion 106*b*, the plunger 108 is brought into a state where the plunger 108 is displaced in the rotational direction of the dial knob 102 (see arrow D1 in FIG. 11) from the radial direction, and when the plunger 108 goes beyond a top of the convex portion 106*b*, due to a resilient repulsive force of the coil spring 112, the plunger 108 moves toward a side opposite to the rotational direction of the dial knob 102 at a stroke and impinges on an inner wall surface 110*b* of the plunger holding portion 110 (see FIG. 12), and a click or impinging sound is generated due to such impinging. As a result, the smooth reciprocating movement of the plunger 108 cannot be acquired because a uniform click feeling cannot be obtained in a rotational operation of the dial knob 102.

In view of the above, a dial switch 120 has been proposed as shown in FIG. 13, which includes a plunger holding portion 122 and a plunger 124. In this dial switch 120, the plunger holding portion 122 has an inner wall surface 126 which extends along the particular radial direction of the dial knob 102 for defining the moving direction of the plunger 124, and the plunger 124 has a slide contact outer peripheral surface 128 which is brought into slide contact with the inner wall surface 126 of the plunger holding portion 122 in a slidable manner along the particular radial direction. In such a dial switch 120, the plunger 124 moves in a state where the slide contact outer peripheral surface 128 is brought into slide contact with the inner wall surface 126 of the plunger holding portion 122 and hence, it is considered that the smooth reciprocating movement of the plunger 124 can be realized, and a uniform click feeling can be acquired in a rotational operation of the dial knob.

However, in this dial switch, a uniform click feeling cannot be acquired in the rotational operation of the dial knob 102.

The exemplary embodiments are directed to a dial switch which can enhance the uniformity of click feeling in a rotational operation of a dial knob.

As a result of experiments repeated for overcoming the above-mentioned drawbacks, inventors of the exemplary embodiments have found that, in the dial switch 120, when the dial knob 102 is rotated, the plunger 124 is pushed by the uneven peripheral surface 106 and the compression coil spring is distorted differently each time the compression coil spring is compressed and hence, the irregularities occur in the direction of a resilient repulsive force applied to the plunger 124 from the coil spring 112 (for example, the direction indicated by an arrow $\alpha$ when the compression coil spring is distorted, as shown in FIG. 14).

When the irregularities occur in the direction of a resilient repulsive force applied to the plunger 124, a frictional force between the slide contact outer peripheral surface 128 of the plunger 124 and the inner wall surface 126 of the plunger holding portion 122 in the reciprocating movement of the plunger 124 may be changed so that a uniform click feeling cannot be acquired in a rotational operation of the dial knob. Further, when a resilient repulsive force acts in the direction inclined with respect to the moving direction, the plunger 124 may move in a reciprocating manner in an inclined state whereby the outer peripheral surface of the plunger 124 may wear non-uniformly.

In view of the above, the inventors of the present exemplary embodiments have focused on several facts including that, in the dial switch where the direction of the reciprocating movement of the plunger 124 is defined by the slide contact between the inner wall surface 126 of the plunger holding portion 122 and the outer peripheral surface 128 of the plunger 124, the coil spring 112 is distorted when the coil spring 112 is compressed whereby the direction of a resilient repulsive force is not fixed.

Accordingly, a dial switch according to exemplary embodiments includes a dial switch having a rotatably operable dial knob rotatable in a rotary direction, and has a rotary portion configured to rotate due to a rotational operation of the dial knob. The rotary portion has an uneven peripheral surface having a concave portion and a convex portion such that the peripheral surface radially retracts and projects in a radial direction orthogonal to the rotary direction while passing through a center of the rotation of the dial knob, and the concave portion and the convex portion being alternately repeated along the rotary direction. The dial switch further has a plunger which is capable of being brought into contact with the uneven peripheral surface; a plunger holding portion which holds the plunger such that the plunger is movable in a reciprocating manner in the radial direction and brought into contact with the uneven peripheral surface; and a compression coil spring which biases the plunger toward the uneven peripheral surface. The plunger holding portion extends along a moving path of the plunger, and has a guide surface which surrounds the plunger from the outside of the moving path. The plunger further has a receiving portion which faces a side opposite to the uneven peripheral surface in front of the receiving portion, the receiving portion being configured to be brought into contact with one end of the compression coil spring, and the receiving portion being configured to receive the biasing force. The plunger further has an outer wall, an inner peripheral surface, and an inner shaft. The outer wall has an outer peripheral surface which extends in the moving path direction of the plunger and is arranged close to the guide surface, and the inner peripheral surface has an inner diameter larger than an outer diameter of the compression coil spring. The an inner shaft extends in the moving path direction inside the outer wall, has a rear end at a position in front of the rear end of the outer wall, and has an outer diameter which allows the compression coil spring to be mounted on an outer side thereof. The compression coil spring is arranged on the plunger holding portion in a state where the compression coil spring is mounted outside the inner shaft and is deformed by resilient compression in the center axis direction of the compression coil spring so that the compression coil spring pushes the plunger to the uneven peripheral surface by a resilient repulsive force of the compression coil spring. The difference between a maximum outer diameter of the inner shaft and an inner diameter of the compression coil spring is smaller than the difference between a minimum inner diameter of the inner peripheral surface of the outer wall and an outer diameter of the compression coil spring.

Due to such a constitution, by making use of the difference in length (the difference in axial length) in the above-mentioned moving path direction between the inner shaft which holds the compression coil spring and the outer wall for stabilizing the posture of the plunger, that is, in the center axis direction of the compression coil spring, the posture of the compression coil spring and the plunger can be stabilized while ensuring an effective length of the compression coil spring.

To be more specific, the inclination of the plunger can be effectively restricted by ensuring a contact length between the outer peripheral surface of the outer wall and the guide surface of the plunger holding portion in the moving path direction by elongating the outer wall, and also the effective length of the compression coil spring can be increased by an amount of the difference in the axial length by holding the compression coil spring in place from the inside of the positioning wall by the inner shaft thus shortening the inner shaft than the outer wall while suppressing distortion at the time of compression by stabilizing the posture of the spring.

Accordingly, the smooth reciprocating movement of the plunger is realized and hence, the uniformity of click feeling can be enhanced in a rotational operation of the dial knob while effectively suppressing the non-uniform wear of the outer peripheral surface of the plunger.

Further, by increasing the effective length of the compression coil spring by making use of the difference in axial length between the outer wall and the inner shaft, compared to a plunger having a rear end with which a compression coil spring is brought into contact, a space for accommodating the compression coil spring behind the plunger can be shortened. Accordingly, while ensuring the contact length between the outer peripheral surface of the outer wall and the guide surface in the moving direction, the miniaturization of the dial switch can be realized by decreasing a length of the plunger holding portion in the axial length direction.

DETAILED DESCRIPTION OF EMBODIMENTS

Figure 1:
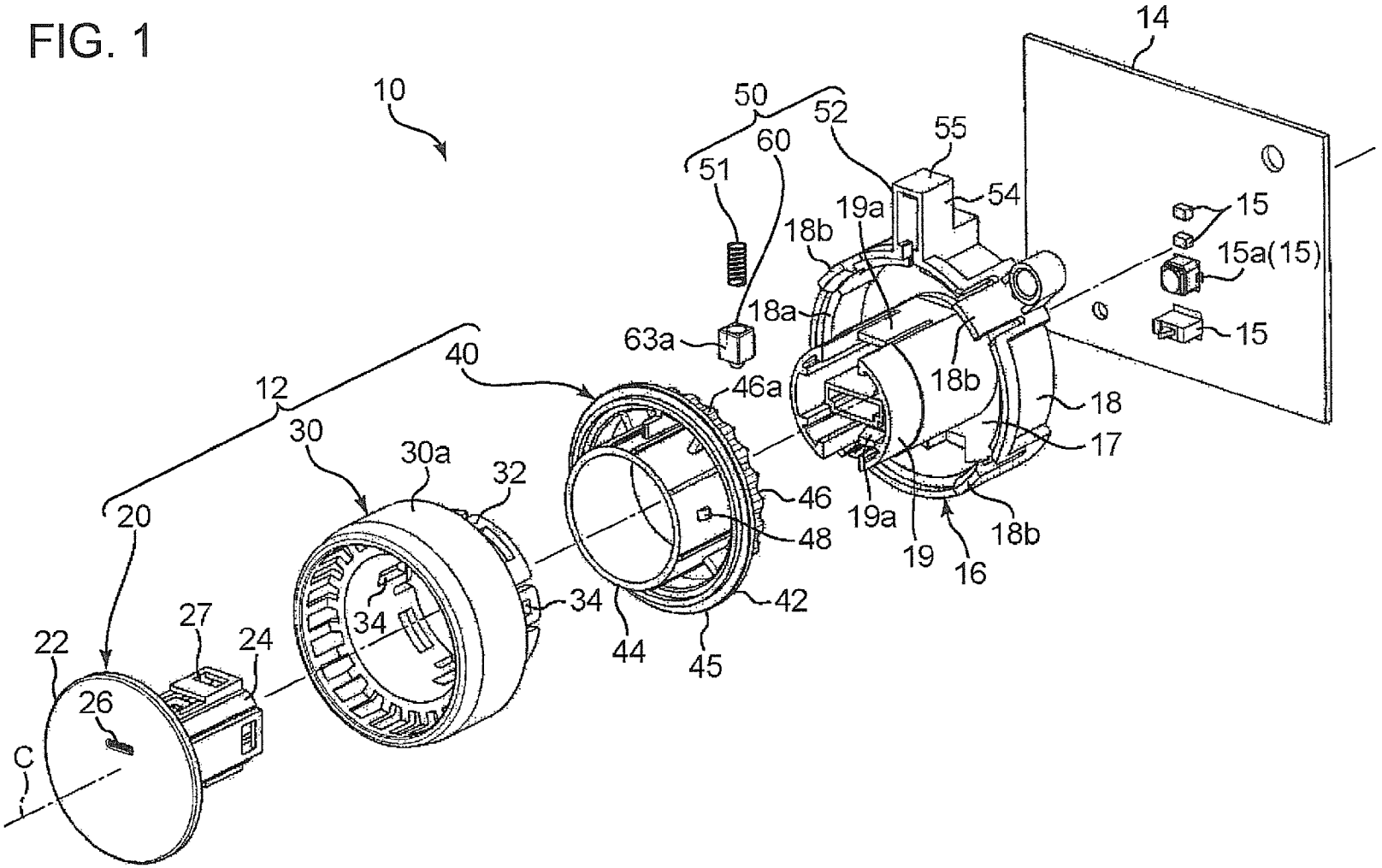
FIG. 1 is an exploded perspective view of a dial switch according to an embodiment.
Figure 2:
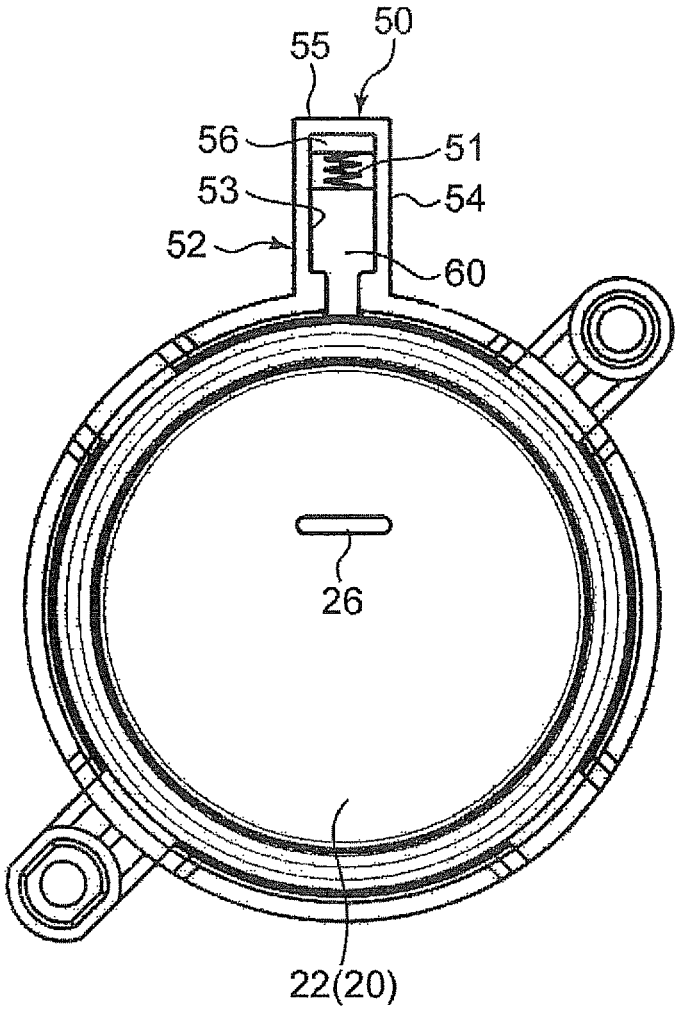
FIG. 2 is a front view of the dial switch in a state where a printed circuit board is removed.
Figure 3:
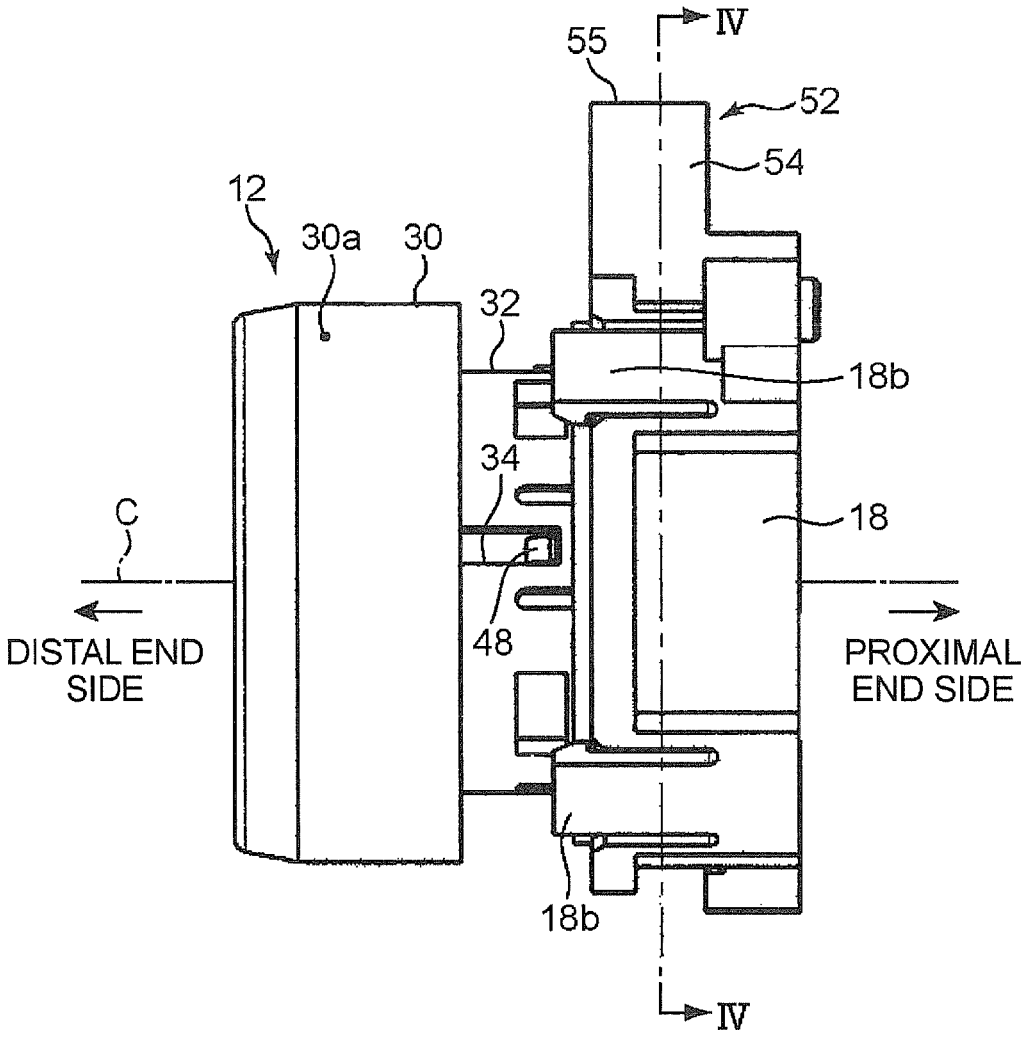
FIG. 3 is a side view of the dial switch in a state where the printed circuit board is removed.
Figure 4:
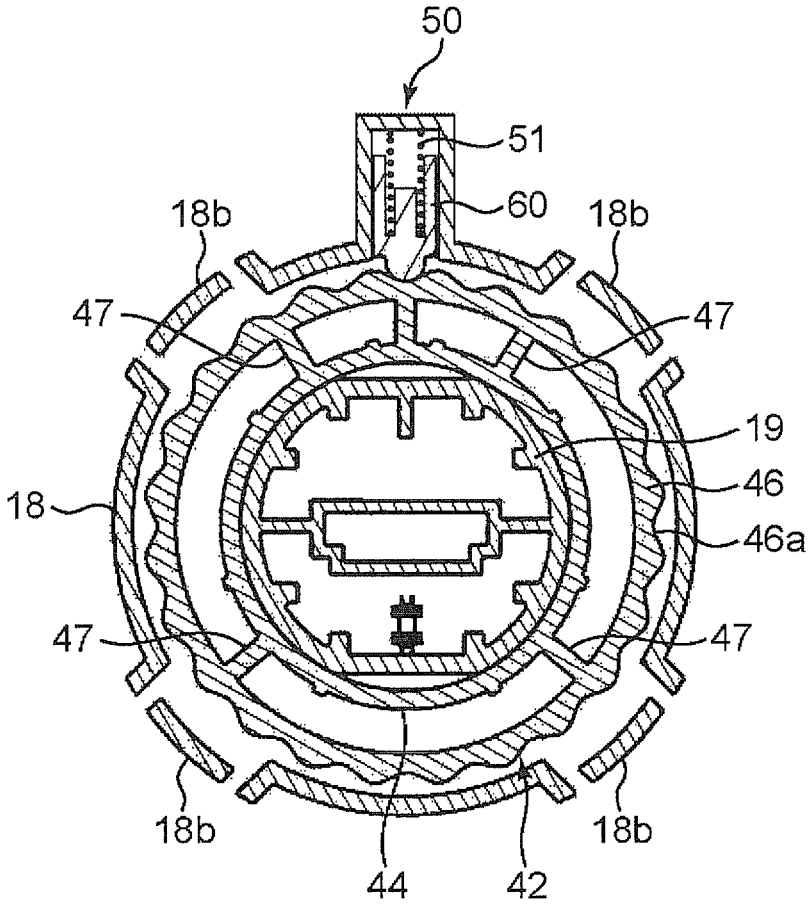
FIG. 4 is a cross-sectional view taken along a line IV-IV in FIG. 3.
Figure 5:
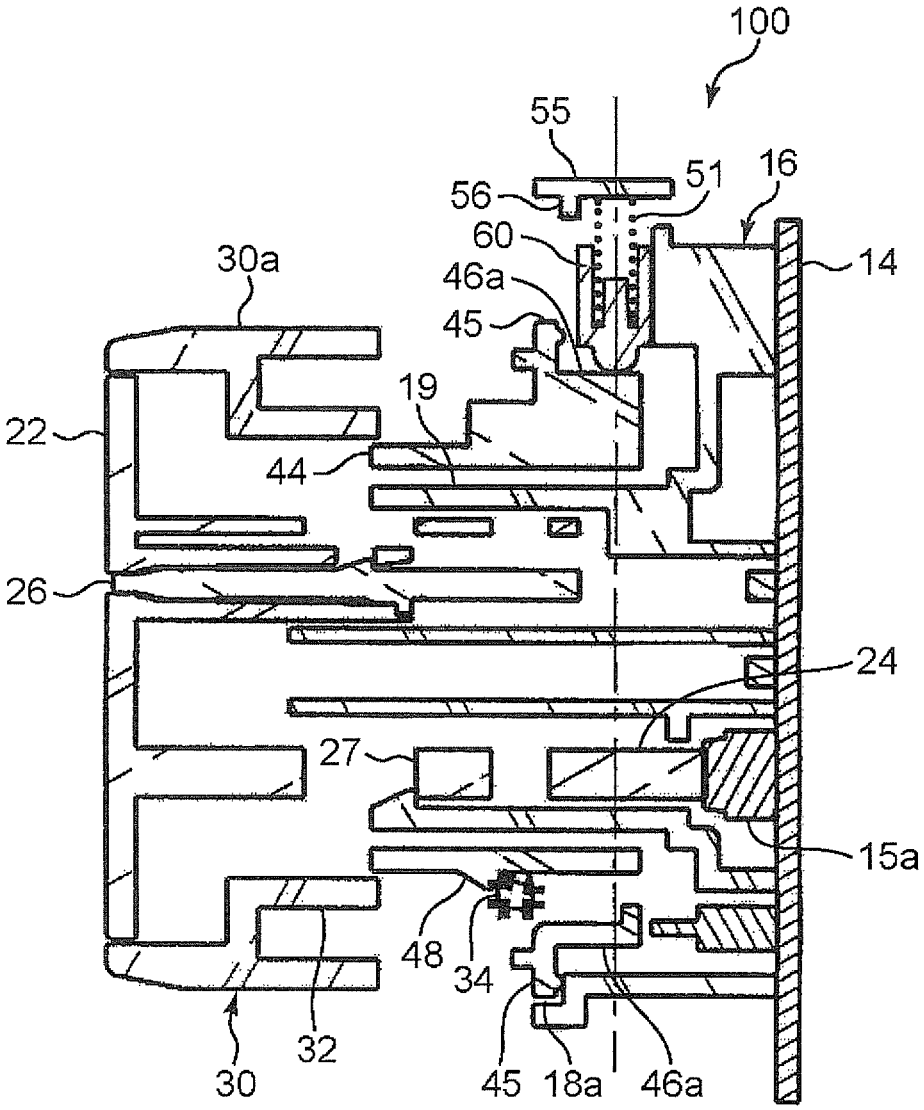
FIG. 5 is a longitudinal cross-sectional view of a center portion of the dial switch.

The exemplary embodiments described herein are described with reference to the drawings.

A dial switch according to an exemplary embodiment is a type of dial switch used for operating an electronic apparatus or the like, and is arranged on an operation panel, which may constitute an interior of a vehicle or the like. As shown in FIG. 1 to FIG. 5, the dial switch includes a dial knob 12 that is rotatably operated, and a support member 16 by means of which the dial knob 12 is rotatably supported on a printed circuit board 14. On a surface of the printed circuit board 14 on which the support member 16 is arranged, a circuit is arranged and a plurality of electronic parts 15 may be mounted.

The dial knob 12 is a part that may rotate about a center axis C, and may include a cylindrical dial member 30, a switch member 20 which is fitted in the inside of a distal end portion of the dial member 30, and a rotary member 40 which is rotated together with the dial member 30.

The dial member 30 may be a substantially cylindrical member where a hole is formed in a center portion of the dial member 30 along the center axis C, and may also be a part that an operator rotatably operates by holding an outer peripheral surface 30*a* of the part. On a proximal portion side of the dial member 30, an engaging cylindrical portion 32 having a diameter smaller than a diameter of a distal end side of the dial member 30 may be formed. A plurality of engaging holes 34 may be formed in the engaging cylindrical portion 32 at predetermined intervals in the circumferential direction such that the engaging holes 34 penetrate the engaging cylindrical portion 32 in the radial direction. In an exemplary embodiment, the proximal portion side corresponds to the printed-circuit-board 14 side in the direction of the center axis C, and the distal end side corresponds to the side opposite of the printed-circuit-board 14 side. Further, the radial direction corresponds to the direction that passes through the center axis C and orthogonally intersects the rotational direction of the dial member 30.

The switch member 20 may include a pushing portion 22 which closes a front-side opening of the dial member 30 and a user pushes with his finger or the like, and a transmission portion 24 which extends rearwardly from the pushing portion 22 along the center axis C for transmitting a pushing force to an electronic part 15*a* arranged on the printed circuit board 14 when the pushing portion 22 is pushed. The pushing portion 22 may be a disc-shaped part that expands in the direction orthogonal to the center axis C, and includes a light emitting portion 26 on a front surface thereof at a position above the center of the front surface (a position where the pushing portion 22 intersects the center axis C). The transmission portion 24 may pass through the inside of the dial member 30 and extend to the electronic part 15*a* mounted on the printed circuit board 14 thus transmitting a force generated when the pushing portion 22 is pushed to the electronic part 15*a*. An engaging hole 27, which extends in the radial direction, may be formed in an upper surface portion and a lower surface portion of a rear end of the transmission portion 24. By making engaging lugs 19*a* of the support member 16 engage with the engaging holes 27, the switch member 20 may be held by the support member 16.

The rotary member 40 may include a ring-shaped rotary body 42, and a cylindrical dial fixing portion 44 that is arranged inside the rotary body 42 coaxially with the rotary body 42.

The rotary body 42 includes a flange portion 45 which expands in the radial direction on a distal end side of the rotary body 42, and an uneven peripheral surface portion 46, which is formed on a proximal portion side of the flange portion 45, and has an outer peripheral surface (uneven peripheral surface) 46*a* formed into a wave shape. By fitting the flange portion 45 in a guide portion 18*a* formed on a distal end of a support cylindrical portion 18 of the support member 16, the rotary member 40 may be rotatably held by the support member 16 about the center axis C. The uneven peripheral surface 46*a* for generating a click feeling when the dial knob 12 is rotatably operated is formed on the uneven peripheral surface portion 46. On the outer peripheral surface (uneven peripheral surface) 46*a* of the uneven peripheral surface portion 46, a concave portion and a convex portion which projects and retracts in the radial direction respectively and are repeated in the circumferential direction. To be more specific, the uneven peripheral surface 46*a* may be a peripheral surface which has a fixed width in the direction of the center axis C at respective positions in the circumferential direction and on which the concave portions and the convex portions smoothly continue in the circumferential direction (see FIG. 4).

The dial fixing portion 44 may be a cylindrical part which is arranged inside the rotary body 42 in a spaced-apart manner from the rotary body 42 by a predetermined distance in the radial direction. The dial fixing portion 44 may be fixed to the rotary body 42 by connection portions 47 which extend in the radial direction from an inner side of the rotary body 42. In an exemplary embodiment, the dial fixing portion 44 may be fixed to the inner side of the rotary body 42 by a plurality of connection portions 47 which are arranged at predetermined intervals in the circumferential direction. The dial fixing portion 44 may be a cylindrical part where an outer diameter is set to a size which corresponds to an inner diameter of the dial member 30 (to be more specific, the engaging cylindrical portion 32) and extends more toward a distal end side than the rotary body 42. The dial fixing portion 44 may be inserted into the inside of the dial member 30 such that an outer peripheral surface of the dial fixing portion 44 is brought into slide contact with an inner peripheral surface of the dial member 30. Here, an engaging projection 48 which projects from the outer peripheral surface of the dial fixing portion 44 may be fitted in the engaging hole 34 formed in the dial member 30. Due to such fitting engagement, the dial member 30 and the rotary member 40 can be connected to each other. Since the dial member 30 and the rotary member 40 can be connected to each other as described above, when the dial member 30 is rotatably operated, the rotary member 40 is also rotated together with the dial member 30.

The support member 16 may include a support cylindrical portion 18 that is raised toward the distal end side from an outer periphery of a base portion 17 that expands along the printed circuit board 14, and an inner cylindrical portion 19 that extends toward the distal end side in the inside of the support cylindrical portion 18 such that the inner cylindrical portion 19 may be arranged coaxially with the support cylindrical portion 18. The support cylindrical portion 18 may include a click portion 50 which, when the dial knob 12 is rotatably operated, acts on the uneven peripheral surface 46*a* of the rotary body 42 and generates a click feeling. Further, on a distal end portion of the support cylindrical portion 18, a guide portion 18*a* having a stepped shape in cross section so as to allow the fitting of flange portion 45 of the rotary body 42 therein is formed. A plurality of restricting pieces 18*b* are formed on the support cylindrical portion 18 at predetermined intervals in the circumferential direction. The restricting pieces 18*b* are resiliently deformed at the time of fitting the flange portion 45 in the guide portion 18*a* so as to allow the flange portion 45 to pass through the guide portion 18*a*. On the other hand, the restricting pieces 18*b* are resiliently returned after the flange portion 45 is fitted in the guide portion 18*a* thus restricting the movement of the flange portion 45 toward the distal end side.

Figure 6:
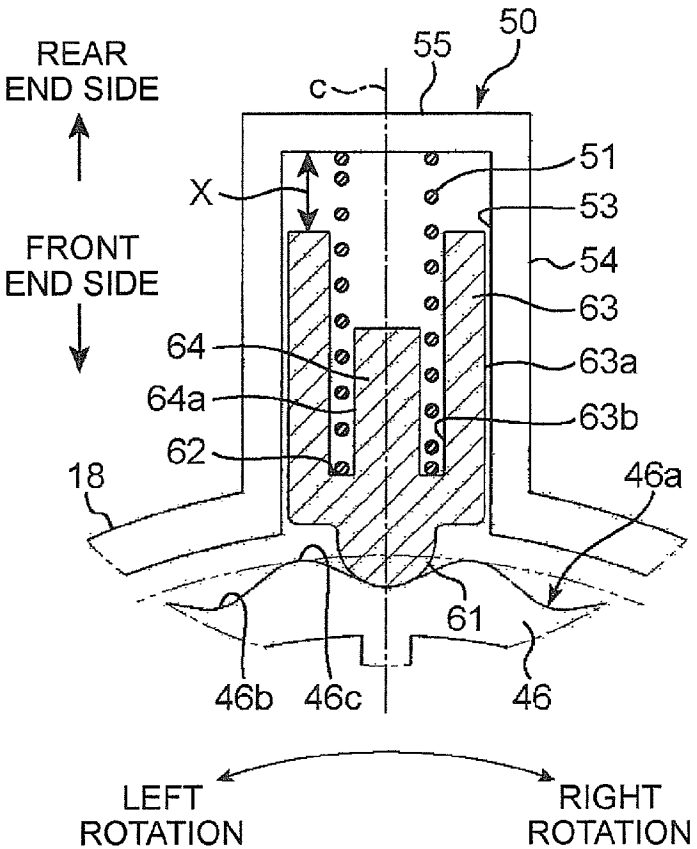
FIG. 6A is a view showing the behavior of a plunger of a click portion and showing a state where the plunger is fitted in a concave portion of an uneven peripheral surface.
FIG. 6B is a view showing the behavior of the plunger of the click portion and showing a state where the plunger is pushed by a convex portion of the uneven peripheral surface.
Figure 6:
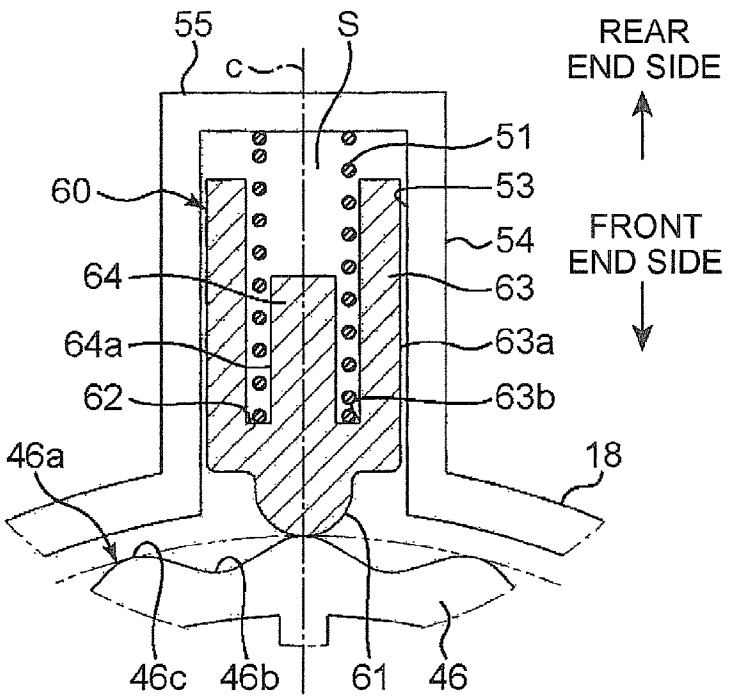

Also, as shown in FIG. 6(A) and FIG. 6(B), the click portion 50 is arranged at an upper end position of the support cylindrical portion 18, and may include a plunger holding portion 52 (hereinafter, also simply referred to as "holding portion"), a plunger 60 which is accommodated (held) in the holding portion 52, and a compression coil spring (hereinafter, also simply referred to as "coil spring") 51 which biases the plunger 60.

The holding portion 52 opens at a position where the plunger 60 faces the uneven peripheral surface 46*a* such that the plunger 60 is brought into contact with the uneven peripheral surface 46*a* of the rotary body 42, and has an inner space S where the plunger 60 is movable in a reciprocating manner along the particular radial direction of the uneven peripheral surface 46*a*. In an exemplary embodiment, the plunger 60 is movable in a reciprocating manner in the vertical direction. To be more specific, the holding portion 52 may include a guide wall 54 which extends along a moving path when the plunger 60 moves in a reciprocating manner and forms a guide surface 53 which surrounds the plunger 60 from the outside about the moving path, and a positioning wall (positioning portion) 55 which closes a radially outer end portion of the guide wall 54 (an end portion remote from the uneven peripheral surface 46*a*). The guide wall 54 may surround the plunger 60 from three sides (from left and right sides and a rear side in FIG. 6(A)) except for a distal end side. On the distal end side where no guide wall 54 is formed, on an upper end portion of the holding portion 52, a restricting wall 56 which restricts the movement of one end of the coil spring 51 to the distal end side when one end of the coil spring 51 may be brought into contact with the positioning wall 55 extends downwardly from the positioning wall 55 (see FIG. 5). As described above, the distal end side of the holding portion 52 is released and hence, the plunger 60 and the coil spring 51 can be assembled in the holding portion 52 even after other members are assembled.

The guide surface 53 guides the plunger 60 as the plunger 60 moves while being in slide contact with the guide surface 53 (when the plunger 60 slides). The guide surface 53 may include a pair of vertically elongated rectangular planes which face each other in an opposed manner so as to sandwich the plunger 60 in the widthwise direction (lateral direction in FIG. 6(A)) and a vertically elongated rectangular plane which connects proximal-portion-side end portions of the pair of planes to each other. As described above, the guide surface 53 extends in the vertical direction and hence, gravity acts on the plunger 60 in the moving direction of the plunger 60, that is, in the direction along the guide surface 53. Accordingly, a frictional force generated between the guide surface 53 and the plunger 60 is hardly influenced by gravity so that highly uniform click feeling can be acquired irrespective of the rotational direction of the dial knob 12.

The positioning wall 55 is a part for positioning one end of the coil spring 51 in the radial direction. In an exemplary embodiment, the positioning wall 55 has a plate shape which expands in the direction orthogonal to the center axis c of the coil spring 51.

The plunger 60 may include a contact portion 61 which is brought into contact with the uneven peripheral surface 46*a*, a receiving portion 62 which faces a side opposite to the uneven peripheral surface 46*a* arranged in front of the receiving portion 62 that is brought into contact with the other end of the coil spring 51 and receives a biasing force (resilient repulsive force) of the coil spring 51, and an outer wall 63 and an inner shaft 64 which extend rearwardly from the receiving portion 62. The plunger 60 may be formed using a material having a small friction coefficient. In an exemplary embodiment, the plunger 60 is formed by injection molding using polyacetal, ABS or the like. In this embodiment, the front side corresponds to a center side of the dial member 30 in the radial direction, and a rear side corresponds to an outer side of the dial member 30 in the radial direction.

The contact portion 61 bulges frontwardly (that is, toward the uneven peripheral surface 46*a*) in a semispherical shape and can be brought into contact with the uneven peripheral surface 46*a*. A specific shape of the contact portion 61 is not limited. That is, although the contact portion 61 is formed into a semispherical shape in an exemplary embodiment, the contact portion 61 may be formed into other shapes provided that the contact portion 61 can be brought into slide contact with the uneven peripheral surface 46*a* when the uneven peripheral surface 46*a* is rotated together with a rotational operation of the dial member 30.

The receiving portion 62 expands in the direction orthogonal to the center axis c of the coil spring 51 behind the contact portion 61, and is brought into contact with the other end of the coil spring 51 so as to receive a resilient repulsive force generated by the coil spring 51. The receiving portion 62 of this embodiment is provided so as to connect the inner shaft 64 and the outer wall 63 to each other.

The outer wall 63 is a cylindrical part which may extend rearwardly in such a manner that the outer wall 63 surrounds the coil spring 51 from the outside. The outer wall 63 includes an outer peripheral surface 63*a* which is arranged close to the guide surface 53, and an inner peripheral surface 63*b* which has an inner diameter larger than an outer diameter of the coil spring 51. The outer peripheral surface 63*a* is a surface which can be brought into contact with the guide surface 53 when the plunger 60 moves in a reciprocating manner. In an exemplary embodiment, the cross section of the outer peripheral surface 63*a* orthogonal to the center axis c of the coil spring 51 is formed into a rectangular shape or a square shape (see FIG. 1). The inner peripheral surface 63*b* is a surface which is spaced apart from an outer side of the coil spring 51 by a predetermined distance. In an exemplary embodiment, the cross section of the inner peripheral surface 63*b* orthogonal to the center axis c of the coil spring 51 is formed into a circular shape. In such an outer wall 63, when the plunger 60 moves in a reciprocating mariner, the outer peripheral surface 63*a* is brought into slide contact with the guide surface 53 so that the inclination of the plunger 60 in the holding portion 52 is suppressed whereby the posture of the plunger 60 is stabilized.

To be more specific, the outer wall 63 may be formed such that a distance between the outer peripheral surface 63*a* and the guide surface 53 is set to 0.05 to 0.1 mm, and a distance between the inner peripheral surface 63*b* and the coil spring 51 is set to 0.05 to 0.1 mm. Further, a longitudinal length of the outer wall 63 is set to 5 mm.

The inner shaft 64 may extend rearwardly inside the outer wall 63. The inner shaft 64 is a part for stabilizing the posture of the coil spring 51 from the inside of the coil spring 51 when the coil spring 51 is deformed by resilient compression (when the coil spring 51 is compressed). That is, when the coil spring 51 is compressed, since the inner shaft 64 is positioned inside the coil spring 51, the distortion of the coil spring 51 can be suppressed.

A rear end of the inner shaft 64 may be arranged at a position in front of a rear end of the outer wall 63. That is, the inner shaft 64 includes an outer peripheral surface 64*a* which has a longitudinal length smaller than a longitudinal length of the outer wall 63 and on which the coil spring 51 can be mounted. By setting the length of the inner shaft 64 smaller than the length of the outer wall 63 in the longitudinal direction, it is possible to stabilize the posture of the coil spring 51 while ensuring an effective length of the coil spring 51 due to the difference in length (hereinafter, also referred to as "difference in axial length"). That is, by holding the coil spring 51 from the inside using the inner shaft 64, the posture of the coil spring 51 can be stabilized thus suppressing the distortion of the coil spring 51 at the time of compression and, at the same time, by making the inner shaft 64 shorter than the outer wall 63, the effective length of the compression coil spring 51 can be increased by an amount of the difference in the axial length while ensuring the contact length between the outer peripheral surface 63*a* of the outer wall 63 and the guide surface 53 in the moving direction (longitudinal direction). By increasing the effective length of the coil spring 51 due to the difference in axial length between the outer wall 63 and the inner shaft 64 in this manner, compared to a conventional plunger where the coil spring 51 is brought into contact with a rear end of the plunger, the space for accommodating the coil spring 51 behind the plunger 60 (see symbol X in FIG. 6(A)) can be shortened and hence, a length of the holding portion 52 in the axial length direction can be decreased thus realizing the miniaturization of the dial switch.

The inner shaft 64 in an exemplary embodiment is formed such that the difference between an outer diameter of the inner shaft 64 and an inner diameter of the coil spring 51 becomes zero. Due to such a constitution, when the coil spring 51 is mounted on the inner shaft 64, the coil spring 51 hardly falls from the plunger 60 (inner shaft 64) and hence, compared to a case where the plunger and the coil spring are arranged separately from each other, it is possible to facilitate an assembling operation of the plunger 60 and the coil spring 51 into the holding portion 52.

For example, the inner shaft 64 is formed such that an outer diameter is set to ϕ4.4 mm, and a longitudinal length is set to 2 mm.

Here, a cross-sectional shape of the inner peripheral surface 63*b* of the outer wall 63 and a cross-sectional shape of the outer peripheral surface 64*a* of the inner shaft 64 may not be a circular shape. That is, it is sufficient that the inner peripheral surface 63*b* of the outer wall 63 extends rearwardly such that the inner peripheral surface 63*b* surrounds the coil spring 51 from the outside and is spaced apart from the outer peripheral surface of the coil spring 51 by a predetermined distance, and a cross-sectional shape of the inner peripheral surface 63*b* may be a polygonal shape such as a quadrangular shape. On the other hand, with respect to a cross-sectional shape of the outer peripheral surface 64*a* of the inner shaft 64, it is sufficient that the coil spring 51 can be mounted on the outer peripheral surface 64*a*, and the cross-sectional shape may be a polygonal shape and the like. Further, a cross-sectional shape of the inner peripheral surface 63*a* of the outer wall 63 and a cross-sectional shape of the outer peripheral surface 64*a* of the inner shaft 64 may differ from each other. In such a case, when a cross-sectional shape of the inner peripheral surface 63*b* of the outer wall 63 and a cross-sectional shape of the outer peripheral surface 64*a* of the inner shaft 64 are not a circular shape along the coil spring 51, the difference between a maximum outer diameter of the inner shaft 64 (for example, a length of a diagonal line when the cross-sectional shape is a square shape) and an inner diameter of the coil sprig 51 is set smaller than the difference between a minimum inner diameter of the inner peripheral surface 63*b* of the outer wall 63 (for example, a length of one side when the cross-sectional shape is a square shape) and an outer diameter of the coil spring 51.

The coil spring 51 biases the plunger 60 toward the uneven peripheral surface. The coil spring 51 may be formed of a piano wire or a stainless steel wire. The coil spring 51 may be arranged in a holding portion 52 in a state where the coil spring 51 is mounted on an outer side of the inner shaft 64. To be more specific, in a compressed state in the direction of the center axis c of the coil spring 51, one end of the coil spring 51 is brought into contact with the positioning wall 55 and the other end of the coil spring 51 is brought into contact with the receiving portion 62 of the plunger 60. Due to such a constitution, the plunger 60 is pushed to the uneven peripheral surface 46*a* due to a resilient repulsive force of the coil spring 51.

The inner cylindrical portion 19 of the support member 16 may extend more toward a distal end side than the support cylindrical portion 18, and an outer diameter of the inner cylindrical portion 19 may be formed with a size corresponding to an inner diameter of the dial fixing portion 44 of the rotary member 40. An engaging lug 19*a* may be formed on an upper end portion and a lower end portion of the inner cylindrical portion 19, respectively. The engaging lug 19*a* may extend toward a distal end side and forms a free end on a distal end thereof, and a projection which projects toward the center axis C is formed on the distal end. Due to the engagement of the projection of the engaging lug 19*a* with the engaging hole 27 formed in a proximal end side of the transmission portion 24 in the switch member 20, the switch member 20 is held on the support member 16.

In such a dial switch 10, a click feeling is generated in the following manner when the dial knob 12 is rotatably operated.

In such a dial switch 10, in a state where the dial knob 12 is not rotatably operated, as shown in FIG. 6(A), the plunger 60 which is biased by the coil spring 51 is brought into contact with the uneven peripheral surface 46*a* in a state where the contact portion 61 of the plunger 60 is fitted in the concave portion 46*b* of the uneven peripheral surface 46*a*.

When the dial knob 12 is rotatably operated from this state, the uneven peripheral surface 46*a* is rotated along with this rotational operation. As a result, the plunger 60 moves toward a rear side by being pushed by the convex portion 46*c* of the uneven peripheral surface 46*a* (see FIG. 6(B)). Here, a force may act on the plunger 60 also in the circumferential direction by the uneven peripheral surface 46*a*. However, since the movement of the plunger 60 in the circumferential direction is restricted by the guide surface 53, the plunger 60 moves toward a rear side straightly along the guide surface 53. When the dial knob 12 is continuously rotated, the contact portion 61 of the plunger 60 goes beyond a top of the convex portion 46*c* and is fitted in the neighboring concave portion 46*b* due to a resilient repulsive force of the coil spring 51 (see FIG. 6(A)). Also in this case, the movement of the plunger 60 in the circumferential direction is restricted by the guide surface and hence, the plunger 60 moves toward a front side straightly along the guide surface 53. So long as this rotation of the dial knob 12 is continued, this series of operations is repeated. In this manner, due to the reciprocating movement of the plunger 60 following the concave portions and convex portions of the uneven peripheral surface 46*a* in a state where the plunger 60 is pushed to the uneven peripheral surface 46*a* due to a resilient repulsive force of the coil spring 51, a torque generated when the dial knob 12 is rotated is periodically changed so that click feeling can be acquired in the rotational operation of the dial knob 12.

In this reciprocating movement of the plunger 60, due to the difference in length in the center axis c direction of the coil spring 51 (difference in axial length) between the inner shaft 64 which holds the coil spring 51 and the outer wall 63 for stabilizing the posture of the plunger 60, it is possible to make the posture of the coil spring 51 and the posture of the plunger 60 stable while ensuring an effective length of the coil spring 51.

That is, due to the elongation of the outer wall 63, it is possible to effectively restrict the inclination of the plunger 60 by ensuring the contact length in the longitudinal direction between the outer peripheral surface 63*a* of the outer wall 63 and the guide surface 53 of the holing portion 52. On the other hand, due to holding of the coil spring 51 by the inner shaft 64 from the inside, the posture of the coil spring 51 can be made stable so that distortion at the time of compression can be suppressed and the inner shaft 64 can be made shorter than the outer wall 63 whereby the effective length of the coil spring 51 can be increased by an amount of the difference in axial length. Accordingly, the smooth reciprocating movement of the plunger 60 can be realized and hence, the non-uniform wear of the outer peripheral surface 63*a* of the plunger 60 can be effectively suppressed, and also the uniformity of click feeling can be enhanced in a rotational operation of the dial knob 12.

Further, by increasing the effective length of the coil spring 51 by making use of the difference in axial length between the outer wall 63 and the inner shaft 64, a space (see X in FIG. 6(A)) for accommodating the coil spring 51 behind the plunger 60 can be shortened compared to a conventional plunger where a coil spring is brought into contact with a rear end of the plunger. Accordingly, while ensuring the contact length in the longitudinal direction between the outer peripheral surface 63*a* of the outer wall 63 and the guide surface 53, the miniaturization of the dial switch 10 can be realized by decreasing a length of the holding portion 52 in the axial length direction.

Further, by elongating the guide surface 53 in the vertical direction, gravity acts on the plunger 60 in the moving direction of the plunger 60, that is, in the direction along the guide surface 53 and hence, a frictional force generated between the guide surface 53 and the plunger 60 is hardly influenced by gravity whereby highly uniform click feeling can be acquired irrespective of the rotary direction of the dial knob 12.

Figure 13:
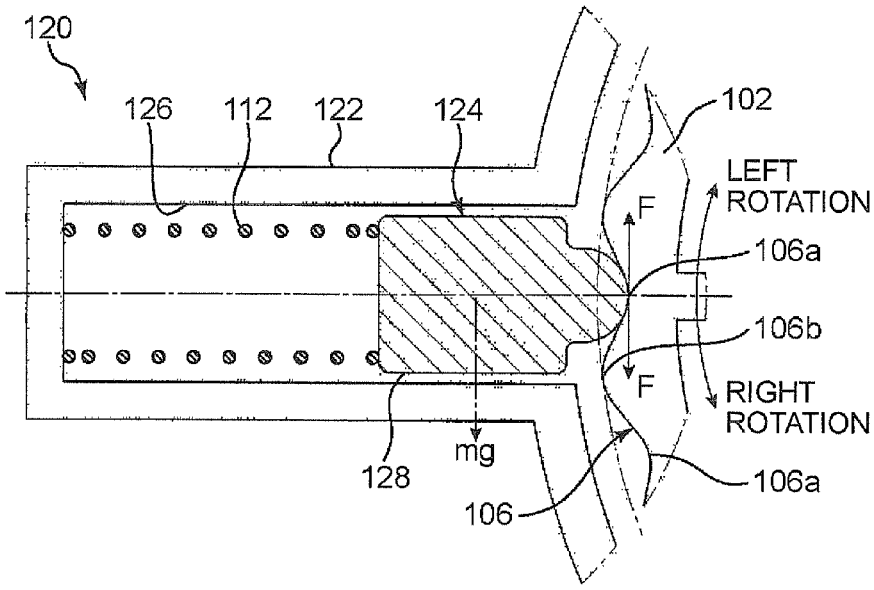
FIG. 13 is a view showing a state of a compression coil spring of a click portion of an another conventional dial switch and showing a state where a plunger is fitted in a concave portion of an uneven peripheral surface and distortion is not generated on the compression coil spring.
Figure 14:
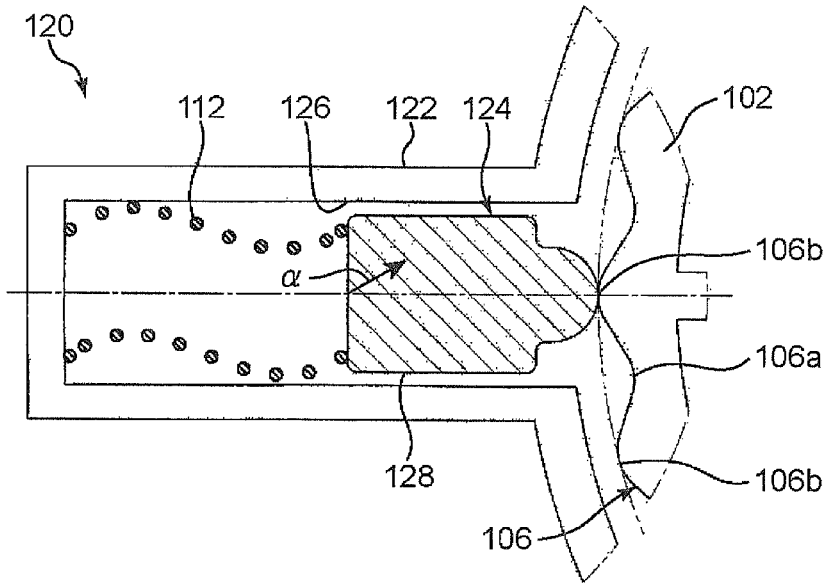
FIG. 14 is a view showing a state of the compression coil spring of the click portion and showing a state where the plunger is pushed by a convex portion of the uneven peripheral surface and distortion is generated on the compression coil spring.

For example, as shown in FIG. 13 and FIG. 14, when a moving path of a plunger 124 is in the horizontal direction, assuming a friction coefficient between the plunger 124 and a guide surface (inner wall surface) 126 as μ, gravity which acts on the plunger 124 as mg, and a force which the plunger 124 receives from an uneven peripheral surface 106 due to the rotation of the uneven peripheral surface 106 as F, the frictional force between the plunger 124 and the guide surface 126 becomes (F+mg)×μ, when the uneven peripheral surface 106 is rotated in the clockwise direction in FIG. 13 (FIG. 14), and becomes (F−mg)×μ when the uneven peripheral surface 106 is rotated in the counterclockwise direction. In this manner, when the frictional force between the plunger 124 and the guide surface 126 is changed depending on the rotary direction, a click feeling is changed depending on the rotary direction of the dial knob and hence, a uniform click feeling cannot be acquired.

To the contrary, as in the case of the plunger 60 in an exemplary embodiment, when the moving path of the plunger 60 is in the vertical direction (see FIG. 6(A)), a frictional force between the plunger 60 and the guide surface 53 becomes F×μ when the uneven peripheral surface 46*a* is rotated in either direction and hence, the frictional force between the plunger 60 and the guide surface 53 is hardly changed depending of the rotary direction. Accordingly, by elongating the guide surface 53 in the vertical direction, a highly uniform click feeling can be acquired irrespective of the rotary direction of the dial knob 12.

Various modifications of the dial switch according to the described exemplary embodiments can be made without departing from the gist of the present invention.

Figure 7:
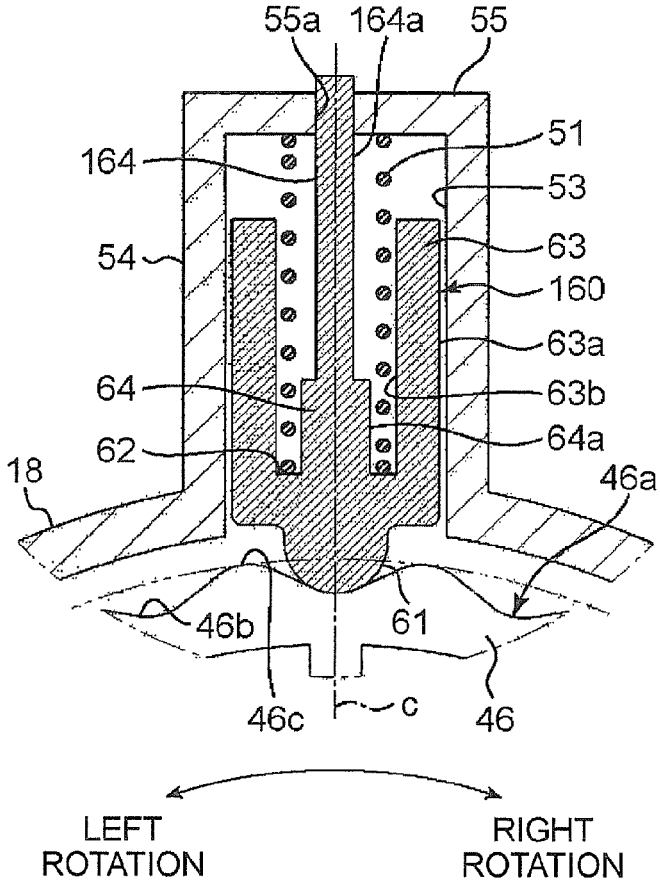
FIG. 7 is an enlarged cross-sectional view of a click portion of a dial switch according to an embodiment.
Figure 8:
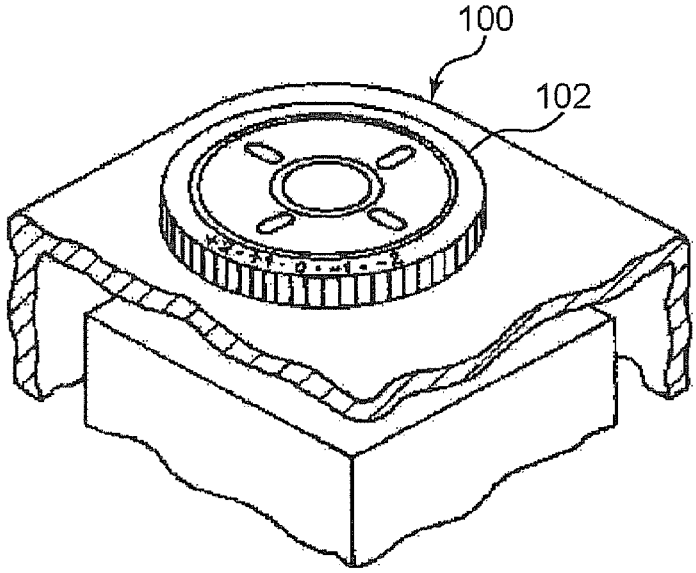
FIG. 8 is a partially enlarged perspective view of an apparatus which uses a conventional dial switch.
Figure 9:
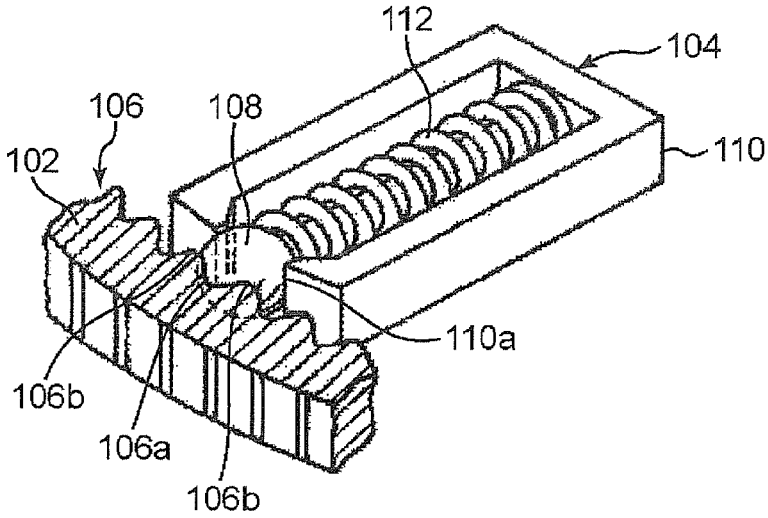
FIG. 9 is an enlarged perspective view of the dial switch around a click portion.
Figure 10:
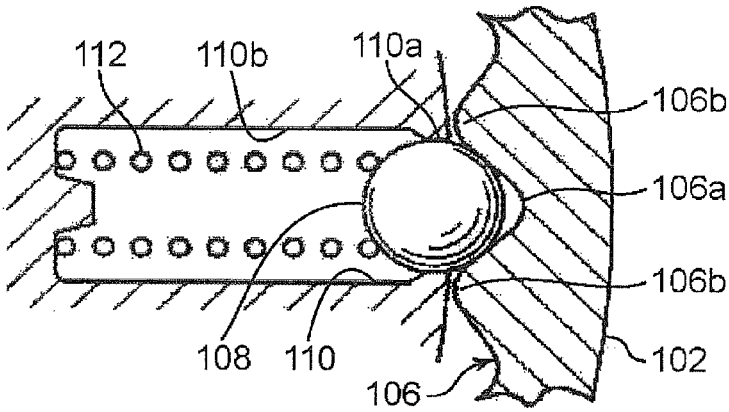
FIG. 10 is a view showing the behavior of a plunger of the click portion and showing a state where the plunger is fitted in a concave portion of an uneven peripheral surface.
Figure 11:
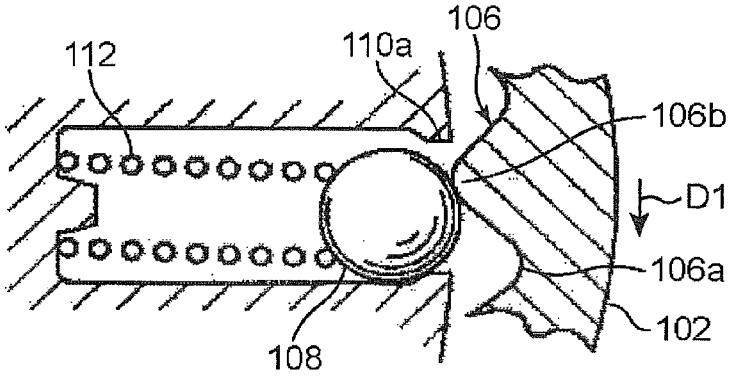
FIG. 11 is a view showing the behavior of the plunger of the click portion and showing a state where the plunger is pushed by a convex portion of the uneven peripheral surface.
Figure 12:
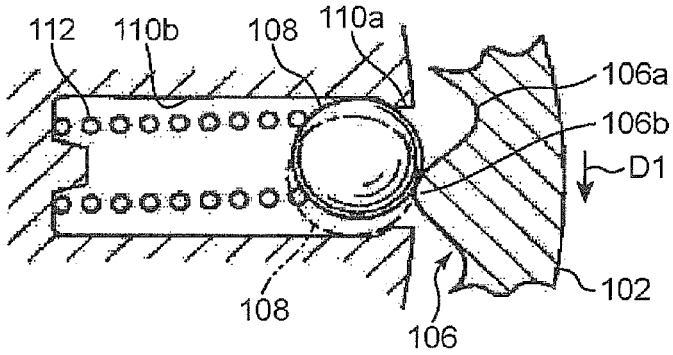
FIG. 12 is a view showing the behavior of the plunger of the click portion and showing a state where the plunger impinges on an inner wall surface of a plunger holding portion.

For example, as shown in FIG. 7, a plunger 160 may include a guided shaft 164. The guided shaft 164 extends from a rear end of the inner shaft 64 and further extends to a position behind a rear end of the outer wall 63 along a center axis of the inner shaft 64 (equal to the center axis c of the coil spring 51). The guided shaft 164 has an outer diameter smaller than an outer diameter of the inner shaft 64. To be more specific, the guided shaft 164 has the outer diameter of ϕ3.8 mm, extends rearward straightly coaxially with the inner shaft 64, and has a circular cross sectional shape in the direction orthogonal to the center axis. In this case, a guide hole which allows the insertion of the guided shaft 164 is fowled in the positioning wall 55, and the guide hole has an inner peripheral surface 55*a* which is brought into slide contact with an outer peripheral surface 164*a* of the guided shaft 164 such that the guided shaft 164 is movable along the center axis c. By providing the guided shaft 164 to the inner shaft 64 as described above, due to the slide contact between the guided shaft 164 and the inner peripheral surface 55*a* of the guide hole formed in the positioning wall 55, the guided shaft 164 is guided along the center axis c direction (direction of the moving path) and hence, the plunger 160 is moved in a reciprocating manner more smoothly. As a result, uniformity of a click feeling can be further enhanced in the rotational operation of the dial knob 12.

Further, in this embodiment, although the holding portion 52 is formed such that the guide surface 53 extends in the vertical direction, the exemplary embodiments are not limited to such a case, and the holding portion 52 may be formed such that a guide surface extends in the horizontal direction or in the inclined direction.

To recapitulate the exemplary embodiments explained heretofore are summarized below.

That is, the dial switch may rotatably operate the dial knob which includes: the rotary portion which rotates due to a rotational operation of the dial knob, and has the uneven peripheral surface on which the concave portion and the convex portion that radially retracts and projects respectively in the radial direction orthogonal to the rotary direction while passing through the center of rotation of the dial knob and are alternately repeated along the rotary direction. The dial knob may also include the plunger, which is capable of being brought into contact with the uneven peripheral surface, and the plunger holding portion, which holds the plunger such that the plunger is movable in a reciprocating manner in the radial direction so that the plunger is brought into contact with the uneven peripheral surface. The dial knob may further include the compression coil spring which biases the plunger toward the uneven peripheral surface. The plunger holding portion may extend along the moving path of the plunger, and have the guide surface which surrounds the plunger from the outside about the moving path. The plunger may include: the receiving portion, which faces the side opposite to the uneven peripheral surface in front of the receiving portion, is brought into contact with one end of the compression coil spring, and receives the biasing force. The plunger may also include the outer wall, which has the outer peripheral surface which extends in the moving path direction of the plunger and is arranged close to the guide surface and the inner peripheral surface having the inner diameter larger than the outer diameter of the compression coil spring. The plunger may further include the inner shaft, which extends in the moving path direction inside the outer wall, has a rear end at the position in front of the rear end of the outer wall, and has the outer diameter which allows the compression coil spring to be mounted on the outer side thereof. The compression coil spring may be arranged on the plunger holding portion in a state where the compression coil spring is mounted outside the inner shaft and is deformed by resilient compression in the center axis direction of the compression coil spring so that the compression coil spring pushes the plunger to the uneven peripheral surface by a resilient repulsive force of the compression coil spring, and the difference between the maximum outer diameter of the inner shaft and the inner diameter of the compression coil spring is smaller than the difference between the minimum inner diameter of the inner peripheral surface of the outer wall and the outer diameter of the compression coil spring.

According to the dial switch of an exemplary embodiment, by making use of the difference in length (the difference in axial length) in the above-mentioned moving path direction between the inner shaft which holds the compression coil spring and the outer wall for stabilizing the posture of the plunger, that is, in the center axis direction of the compression coil spring, the posture of the compression coil spring and the plunger can be stabilized while ensuring an effective length of the compression coil spring.

To be more specific, the inclination of the plunger can be effectively restricted by ensuring the contact length between the outer peripheral surface of the outer wall and the guide surface of the plunger holding portion in the moving path direction by elongating the outer wall, and also the effective length of the compression coil spring can be increased by an amount of the difference in the axial length by holding the compression coil spring in place from the inside of the positioning wall by the inner shaft thus shortening the inner shaft than the outer wall while suppressing distortion at the time of compression by stabilizing the posture of the spring.

Accordingly, the smooth reciprocating movement of the plunger is realized and hence, the uniformity of a click feeling can be enhanced in a rotational operation of the dial knob while effectively suppressing the non-uniform wear of the outer peripheral surface of the plunger.

Further, by increasing the effective length of the compression coil spring by making use of the difference in axial length between the outer wall and the inner shaft, compared to a plunger having a rear end with which a compression coil spring is brought into contact, the space for accommodating the compression coil spring behind the plunger can be shortened. Accordingly, while ensuring the contact length between the outer peripheral surface of the outer wall and the guide surface in the moving direction, the miniaturization of the dial switch can be realized by decreasing a length of the plunger holding portion in the axial length direction.

Further, the maximum outer diameter of the inner shaft is set such that the difference between the maximum outer diameter of the inner shaft and the inner diameter of the compression coil spring becomes zero. Due to such a constitution, an operation of assembling the plunger and the compression coil spring into the plunger holding portion can be facilitated. To be more specific, in the operation of assembling the plunger and the compression coil spring into the plunger holding portion, the difference between the inner diameter of the compression coil spring and the maximum outer diameter of the inner shaft becomes zero when the compression coil spring is held by the inner shaft from the inside and hence, the compression coil spring hardly falls from the inner shaft. Accordingly, the assembling operation is facilitated compared to a case where the plunger and the compression coil spring are assembled into the plunger holding portion separately.

The plunger further includes the guided shaft which extends toward the position behind the rear end of the outer wall from the rear end of the inner shaft along the center axis of the inner shaft, and has the outer diameter smaller than the outer diameter of the inner shaft, the plunger holding portion includes the positioning portion which positions the other end of the compression coil spring at the position behind the plunger, and the guide hole which allows the insertion of the guided shaft therein is foamed in the positioning portion, and the guide hole has the inner peripheral surface which is brought into slide contact with the outer peripheral surface of the guided shaft such that the guided shaft moves along the center axis. Due to such a constitution, the guided shaft is guided along the center axis direction (moving path direction) in a state where the guided shaft is brought into slide contact with the inner peripheral surface of the guide hole formed in the positioning portion and hence, the plunger moves in a reciprocating manner more smoothly.

Further, the guide surface of the plunger holding portion extends in the vertical direction. Due to such a constitution, gravity acts on the plunger in the moving direction of the plunger, that is, in the direction along the guide surface. Accordingly, a frictional force generated between the guide surface and the plunger is hardly influenced by gravity and hence, a highly uniform click feeling can be acquired irrespective of the rotational direction of the dial knob.

To be more specific, for example, as shown in FIG. 13 and FIG. 14, when a moving path of the plunger is in the horizontal direction, assuming a friction coefficient between the plunger and the guide surface as gravity which acts on the plunger as mg, and a force which the plunger receives from the uneven peripheral surface due to the rotation of the uneven peripheral surface as F, the frictional force between the plunger and the guide surface becomes $(F+mg)\times\mu$ when the uneven peripheral surface is rotated in the clockwise direction in FIG. 13 (FIG. 14), and becomes $(F-mg)\times\mu$ when the uneven peripheral surface is rotated in the counterclockwise direction. In this manner, when the frictional force between the plunger and the guide surface is changed depending on the rotary direction, click feeling is changed depending on the rotary direction of the dial knob and hence, uniform click feeling cannot be acquired.

To the contrary, when the guide surface extends in the vertical direction, the moving path of the plunger which is guided by the guide surface extends in the vertical direction and hence, a frictional force between the plunger and the guide surface becomes $F\times\mu$ when the uneven peripheral surface is rotated in either direction and hence, the frictional force between the plunger and the guide surface is hardly changed depending on the rotary direction. Accordingly, by elongating the guide surface in the vertical direction, highly uniform click feeling can be acquired irrespective of the rotary direction of the dial knob.

The dial switch according to the exemplary embodiments is useful as a dial switch used in an operation of an electronic apparatus or the like mounted on a vehicle or the like, and is suitable for enhancing uniformity of a click feeling in a rotational operation of the dial knob.

The foregoing descriptions of exemplary embodiments have been presented for purposes of illustration and description. They are not intended to be exhaustive or to limit the claimed subject matter to the precise forms disclosed, and obviously many modifications and variations are possible in light of the above teaching. The embodiments were chosen and described in order to best explain principles and practical applications of the invention, and to thereby enable others skilled in the art to best utilize the invention and various embodiments with various modifications as are suited to the particular use contemplated. It is understood that various omissions and substitutions of equivalents are contemplated as circumstances may suggest or render expedient, but these are intended to cover the application or implementation without departing from the spirit or scope of the claims of the present claimed subject matter.

The invention claimed is:

1. A dial switch comprising:

a rotatably operable dial knob rotatable in a rotary direction, the dial knob including:

a rotary portion configured to rotate due to a rotational operation of the dial knob, the rotary portion having an uneven peripheral surface having a concave portion and a convex portion such that the peripheral surface radially retracts and projects in a radial direction orthogonal to the rotary direction while passing through a center of the rotation of the dial knob, the concave portion and the convex portion being alternately repeated along the rotary direction;

a plunger which is capable of being brought into contact with the uneven peripheral surface;

a plunger holding portion which holds the plunger such that the plunger is movable in a reciprocating manner in the radial direction so that the plunger is brought into contact with the uneven peripheral surface; and a compression coil spring which biases the plunger toward the uneven peripheral surface, wherein the plunger holding portion extends along a moving path of the plunger, and has a guide surface which surrounds the plunger from an outside of the moving path, and the plunger further includes:

a receiving portion facing a side opposite to the uneven peripheral surface in front of the receiving portion, the receiving portion being configured to be brought into contact with one end of the compression coil spring, and the receiving portion being configured to receive the biasing force;

an outer wall has an outer peripheral surface which extends in the moving path direction of the plunger and is arranged close to the guide surface, and an inner peripheral surface having an inner diameter larger than an outer diameter of the compression coil spring; and an inner shaft extends in the moving path direction inside the outer wall, has a rear end at a position in front of the rear end of the outer wall, and has an outer diameter which allows the compression coil spring to be mounted on an outer side thereof, wherein the compression coil spring is arranged on the plunger holding portion in a state where the compression coil spring is mounted outside the inner shaft and is deformed by resilient compression in the center axis direction of the compression coil spring so that the compression coil spring pushes the plunger to the uneven peripheral surface by a resilient repulsive force of the compression coil spring, and the difference between a maximum outer diameter of the inner shaft and an inner diameter of the compression coil spring is smaller than the difference between a minimum inner diameter of the inner peripheral surface of the outer wall and an outer diameter of the compression coil spring.

2. The dial switch according to claim 1, wherein the maximum outer diameter of the inner shaft is set such that the maximum outer diameter of the inner shaft and the inner diameter of the compression coil spring is substantially the same.

3. The dial switch according to claim 1, wherein the plunger further comprises:

a guided shaft which extends toward a position behind a rear end of the outer wall from a rear end of the inner shaft along a center axis of the inner shaft, and has an outer diameter smaller than the outer diameter of the inner shaft;

the plunger holding portion including a positioning portion which positions the other end of the compression coil spring at a position behind the plunger; and a guide hole which allows the insertion of the guided shaft in the positioning portion, and the guide hole has an inner peripheral surface which is brought into slide contact with an outer peripheral surface of the guided shaft such that the guided shaft moves along the center axis of the inner shaft.

4. The dial switch according to claim 1, wherein a guide surface of the plunger holding portion extends in a vertical direction.

5. The dial switch according to claim 2, wherein the plunger further comprises:

a guided shaft which extends toward a position behind a rear end of the outer wall from a rear end of the inner shaft along a center axis of the inner shaft, and has an outer diameter smaller than the outer diameter of the inner shaft;

the plunger holding portion including a positioning portion which positions the other end of the compression coil spring at a position behind the plunger; and a guide hole which allows the insertion of the guided shaft in the positioning portion, and the guide hole has an inner peripheral surface which is brought into slide contact with an outer peripheral surface of the guided shaft such that the guided shaft moves along the center axis of the inner shaft.

6. The dial switch according to claim 2, wherein a guide surface of the plunger holding portion extends in a vertical direction.

7. The dial switch according to claim 3, wherein a guide surface of the plunger holding portion extends in a vertical direction.

8. The dial switch according to claim 5, wherein a guide surface of the plunger holding portion extends in a vertical direction.

9. The dial switch according to claim 4, wherein the guide surface includes a pair of vertically elongated rectangular planes which face each other between the plunger in a widthwise direction and a vertically elongated rectangular plane which connects proximal-portion-side end portions of the pair of planes to each other.

10. The dial switch according to claim 1, wherein an outer peripheral surface of the inner shaft comprises a longitudinal length smaller than a longitudinal length of the outer wall and on which the coil spring can be mounted.

11. The dial switch according to claim 1, wherein a cross-sectional shape of the inner peripheral surface may be a circular or polygonal shape.

12. The dial switch according to claim 1, wherein the plunger holding portion may be formed such that a guide surface extends in the horizontal direction or in the inclined direction or in a vertical direction.

* * * * *